US010143237B2

(12) United States Patent
Watson

(10) Patent No.: US 10,143,237 B2
(45) Date of Patent: Dec. 4, 2018

(54) VAPORIZER WITH IMPROVED TIP

(71) Applicant: Zipline Innovations, LLC, Denver, CO (US)

(72) Inventor: James Matthew Watson, Katy, TX (US)

(73) Assignee: Zipline Innovations, LLC, Denver, CO (US)

( * ) Notice: Subject to any disclaimer, the term of this patent is extended or adjusted under 35 U.S.C. 154(b) by 14 days.

(21) Appl. No.: 15/581,846

(22) Filed: Apr. 28, 2017

(65) Prior Publication Data

US 2018/0310618 A1 Nov. 1, 2018

(51) Int. Cl.
*A24F 47/00* (2006.01)
*H05B 3/06* (2006.01)

(52) U.S. Cl.
CPC ..... *A24F 47/008* (2013.01); *H05B 3/06* (2013.01)

(58) Field of Classification Search
CPC ..... A24F 4/008
USPC ..... 131/328–329
See application file for complete search history.

(56) References Cited

U.S. PATENT DOCUMENTS

2016/0100633 A1* 4/2016 Gao ..... A24F 47/008 131/329
2016/0106153 A1* 4/2016 Zhu ..... A24F 47/008 131/329
2016/0249684 A1* 9/2016 Liu ..... A24F 47/008 131/328

* cited by examiner

*Primary Examiner* — Phuong Dinh
(74) *Attorney, Agent, or Firm* — Seyfarth Shaw LLP

(57) ABSTRACT

Disclosed is a vaporizer and associated tip where the tip extension is made of a more structurally stable two-component design to reduce the probability of failure in an area prone to failure. In particular, the tip can include a first extension closer to the body and that is made of a more ductile material than a ceramic (e.g., metal), and a second extension closer to the coil of the tip that is made of ceramic. The more ductile portion can therefore absorb impacts and stresses applied to the far end of the tip, while the ceramic portion can dissipate heat from the coil in a more effective manner.

5 Claims, 7 Drawing Sheets

VAPORIZER WITH IMPROVED TIP

TECHNICAL FIELD OF THE INVENTION

The present application relates generally to vaporizers. More particularly, the present application relates to vaporizers and tips with improved structural stability.

BACKGROUND OF THE INVENTION

Vaporizers are a well-known means of smoking an herbal product, such as a concentrate. A user can press a button to heat a coil to a temperature whereby the product is heated and active ingredients in the product are converted to a vapor that the user can inhale. Vaporizers are thought to be a more healthy way of consuming the product because the coil can heat to a temperature sufficient to combust mainly the active ingredients without significantly combusting other parts of the product that would produce carcinogens.

Various tips are used to heat herbal products prior to consumption. For example, vaporizer or atomizer tips can be removably coupled to a body of a vaporizer and activated to heat the product. An exemplary tip is shown in FIG. 7. As shown, the tip 700 includes a base 705 with an extension 710 extending to an end that includes a coil 715 that is heated using components inside the base 705 and elsewhere in the vaporizer. The extension 710 is generally made of a ceramic material, which can be brittle. The extension 710 therefore suffers from failure closer to the base 705 due to the long moment arm when stress is applied to the end of the tip 700 closer to the coil 715, for example, when the user presses the tip-end against product to consume the product. Due to the high frequency of the tip contacting product, which is usually on a hard surface, the tip 700 can break easily over a short period of time or even during transit to a retailer.

SUMMARY OF THE INVENTION

The presently disclosed embodiments include a vaporizer and associated tip where the tip extension includes two or more portions that provide a more structurally stable tip. For example, the tip can include a metallic portion closer to the body of the tip, and a ceramic portion extending from the metallic portion and connecting to a coil. In this manner, the tip can include a more ductile section (here, the metallic section) in an area where the moment arm of tip-end stresses would otherwise cause failure of the tip due to the brittle nature of the ceramic.

For example, the presently disclosed embodiments include a vaporizer having first and second ends and including a tip located at a first end, a body extending from the tip and having a vent hole connecting to the tip and allowing air to flow from the tip through the body and out of the body through the vent hole. A cap can be coupled to the body opposite the tip. The cap can include a mouthpiece with an orifice such that air can flow from the tip, through the body, and out through the orifice. A power source can be disposed within the body and coupled to the tip to cause the tip to heat when so selected by a user. The tip can include a heating element capable of being activated by the power source upon selective activation by a user, a first portion surrounding the heating element and composed of a first material, and a second portion extending from the first portion and composed of a second material more ductile than the first material.

Further described is a vaporizer tip including a base, a stem electrically connected to a power source, and a heating element capable of being activated by the power source upon selective activation by a user. The power can be transferred from the power source through the stem and to the heating element. The tip can further include a first portion surrounding the heating element and composed of a first material, and a second portion extending from the first portion and composed of a second material more ductile than the first material.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF THE EMBODIMENTS

Figure 1:
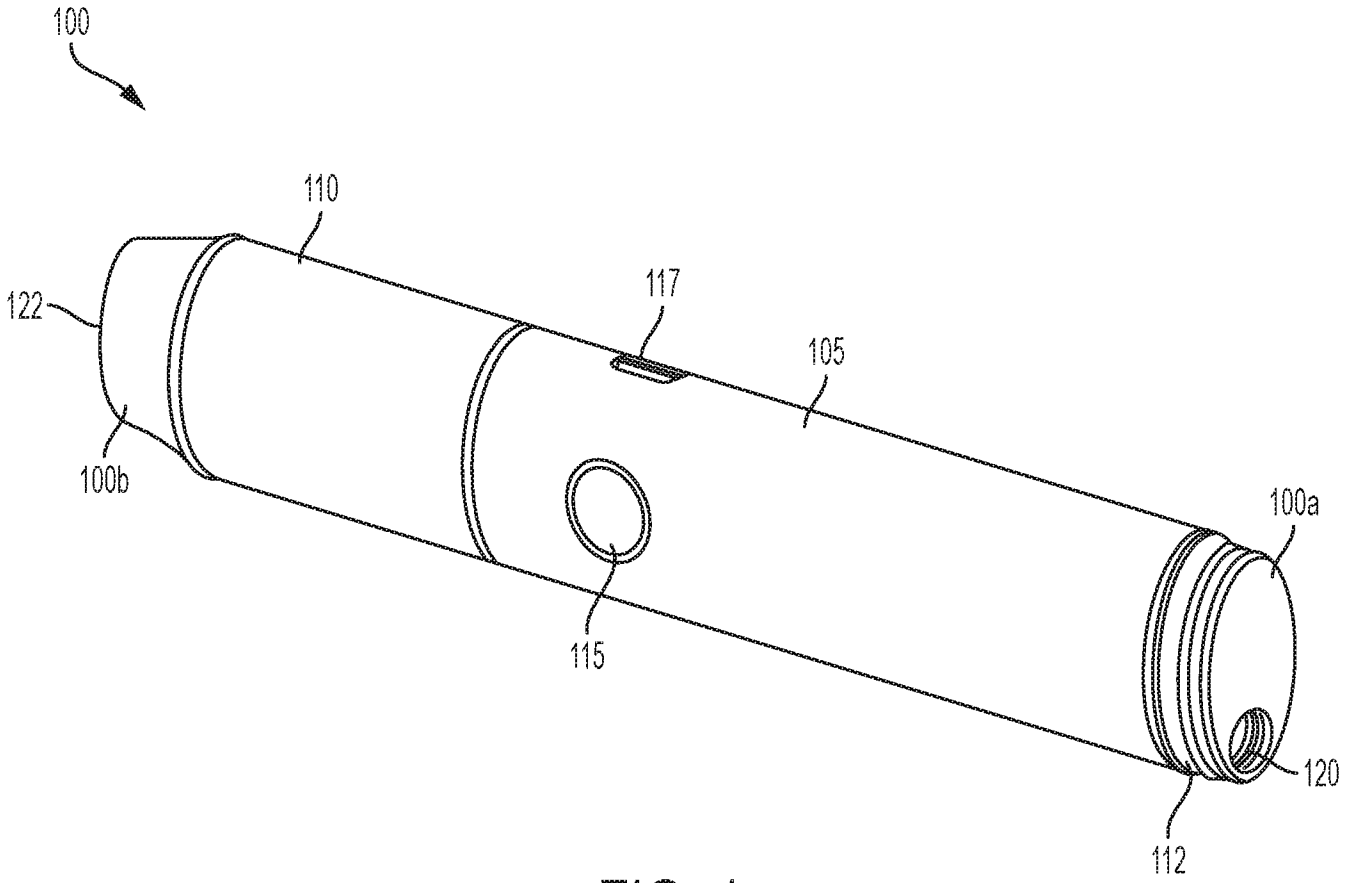
FIG. 1 is a front perspective view of a vaporizer according to at least some of the presently disclosed embodiments.

While this invention is susceptible of embodiments in many different forms, there is shown in the drawings, and will herein be described in detail, a preferred embodiment of the invention with the understanding that the present disclosure is to be considered as an exemplification of the principles of the invention and is not intended to limit the broad aspect of the invention to embodiments illustrated. As used herein, the term "present invention" is not intended to limit the scope of the claimed invention and is instead a term used to discuss exemplary embodiments of the invention for explanatory purposes only.

The presently disclosed embodiments include a vaporizer and associated tip where the tip extension is more structurally stable due to the use of multiple tip extension sections. In particular, the tip can include a first extension closer to the body and that is made of a more ductile material than a ceramic, and a second extension closer to the coil of the tip that is made of ceramic, which dissipates heat in a more effective manner. For example, the tip can include a metallic portion closer to the body of the tip, and a ceramic portion extending from the metallic portion and connecting to a coil. In this manner, the tip can include a more ductile section in an area where the moment arm of coil- or end-based stresses would otherwise create cracks, breakage, or other failure.

As shown in FIG. 1, a vaporizer 100 can include a body 105 that serves as the structural backbone of the vaporizer 100 and a cap 110 to cover an end of the body 105. The vaporizer 100 can include first 100*a* and second 100*b* ends, with a rim 112 located on the first end 100*a* to receive the cap 110 when the cap 110 is removed from the second end 100*b*, for example, during use. In this manner, the cap 110 can be coupled to the vaporizer 100 and is less likely to be lost by the user during use. The cap 110 can also be coupled to the vaporizer second end 100*b* and a user can dip the first end into product, and inhale at the second end 100*b* through the cap 110 opening.

The vaporizer 100 can include a power button 115 that can be activated by a user to cause the powering of a heating element, such as a coil, that heats a product. In at least some embodiments, the power button 115 can be pushed to provide power to the coil, and when the user removes their finger from the power button 115, power will immediately cease to flow to the coil so that the coil can cool. The power facilitated by the power button can come from a variety of sources, for example, a battery or electrical socket. In at least some embodiments, the vaporizer 100 can include a charging port 117 that couples to a power adapter to charge the battery of the vaporizer 100.

The vaporizer 100 can include an air hole 120 located at or near the first end 100*a*, and a mouthpiece 122 with its corresponding hole at the second end 100*b*. A tip 130 (illustrated further in FIGS. 2-6) can also be located near or at the second end 100*b* where the user can contact the tip 130 against a product and activate the power button 115 to heat the tip 130 with a coil or other known means. The air hole 120 therefore begins a ventilation path that ends at the orifice of the mouthpiece when the user inhales the product. The ventilation path provides air from the air hole 120, through the body 105 and cap 110, and out through the orifice of the mouthpiece 122. Alternatively, or in addition to the above, the air flow path can begin near the tip 130 where product is heated, and can flow from the tip 130 through the body 105, out through the air hole 120 and through the mouthpiece 122 when the mouthpiece 122 is placed on the rim 112 during use.

The mouthpiece 122 can include an orifice through which a user can inhale product, as is well known in the art. The mouthpiece 122 can be removably couplable to the body 105 or, as discussed below, at an opposite end of the vaporizer 100. The mouthpiece 122 can further be curved to ergonomically fit the lips or mouth of the user.

FIGS. 2-6 illustrate a tip 130 according to at least some of the presently disclosed embodiments. As discussed previously, the tip 130 is used for heating and combusting product to be consumed by a user. The tip 130 can include a base 140 coupled to a taper 145 that leads to a metallic portion 147 and a ceramic portion 150. The ceramic portion 150 can include gaps 155 that allow for better ventilation if the vaporizer 100 is pressed flat against the surface upon which it sits, such as while the user is dipping the vaporizer 100 and consuming product. Without these gaps 155, the tip 130 would have no air inlets into the vaporizer because the end of the tip 130 would be completely obstructed. Allowing these gaps 155, the tip 130 can be pressed flat against the surface upon which it sits and product can be consumed with sufficient ventilation and air flow.

Figure 6:
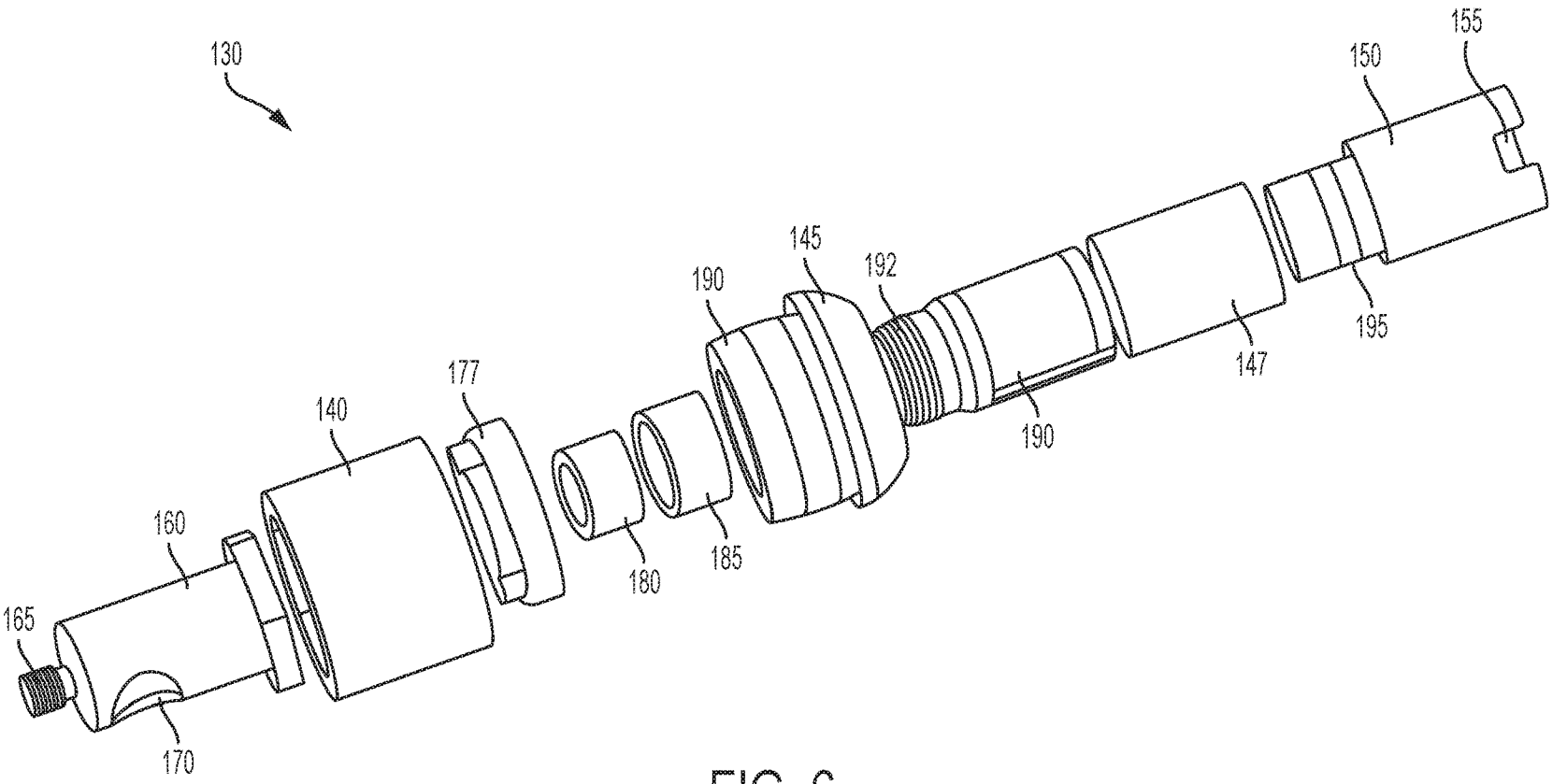
FIG. 6 is an exploded side view of a vaporizer tip according to at least some of the presently disclosed embodiments.
Figure 7:
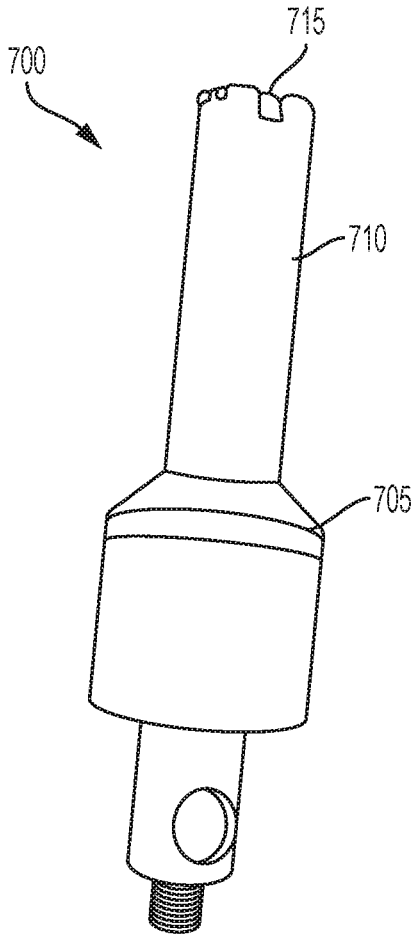
FIG. 7 is a conventional vaporizer tip.

As shown in FIGS. 2-6, the combination of the metallic portion 147 and the ceramic portion 150 provides a more structurally stable tip 130 as opposed to the entirely ceramic tip of the prior art, shown in FIG. 7. The user most often contacts the tip 130 at the second end 100*b* of the vaporizer when contacting product. Because ceramic is a brittle material, the tip of FIG. 7 was prone to failure by shear stress or impact, for example, when placing the tip near the product in a clumsy manner. The stress caused on the far axial end of the tip created a significant moment arm for other cross-sections of the tip away from the far axial end. Accordingly, the significant moment arm, shear stress or tensile/compressive stress from use, and brittle ceramic material caused failure in the ceramic tip, most often closer to the base 705. The tip 130 of the presently disclosed embodiments includes a metallic portion 147 that reduces the moment arm of any stresses or impacts on the far axial end of the tip 130 as applied against the ceramic portion 150. The longer moment arm stresses are applied against the more ductile metallic portion 147, reducing the likelihood of failure. Because metal is a tougher material than most ceramics, the metallic portion 147 provides the necessary toughness at the higher moment arm areas, while the ceramic portion 150 provides the necessary heat dissipation and heat conductivity required to adequately heat the product prior to consumption.

Figure 2:
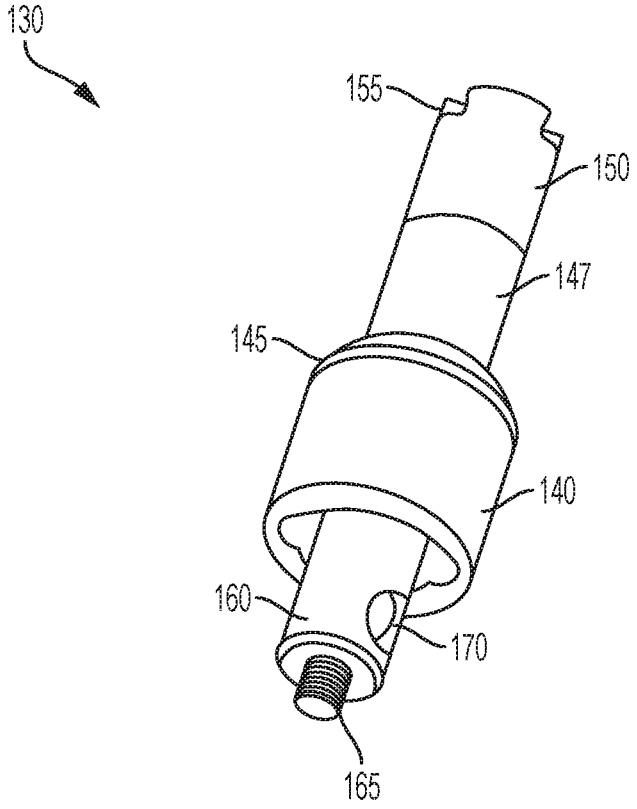
FIG. 2 is a front perspective view of a vaporizer tip according to at least some of the presently disclosed embodiments.
Figure 3:
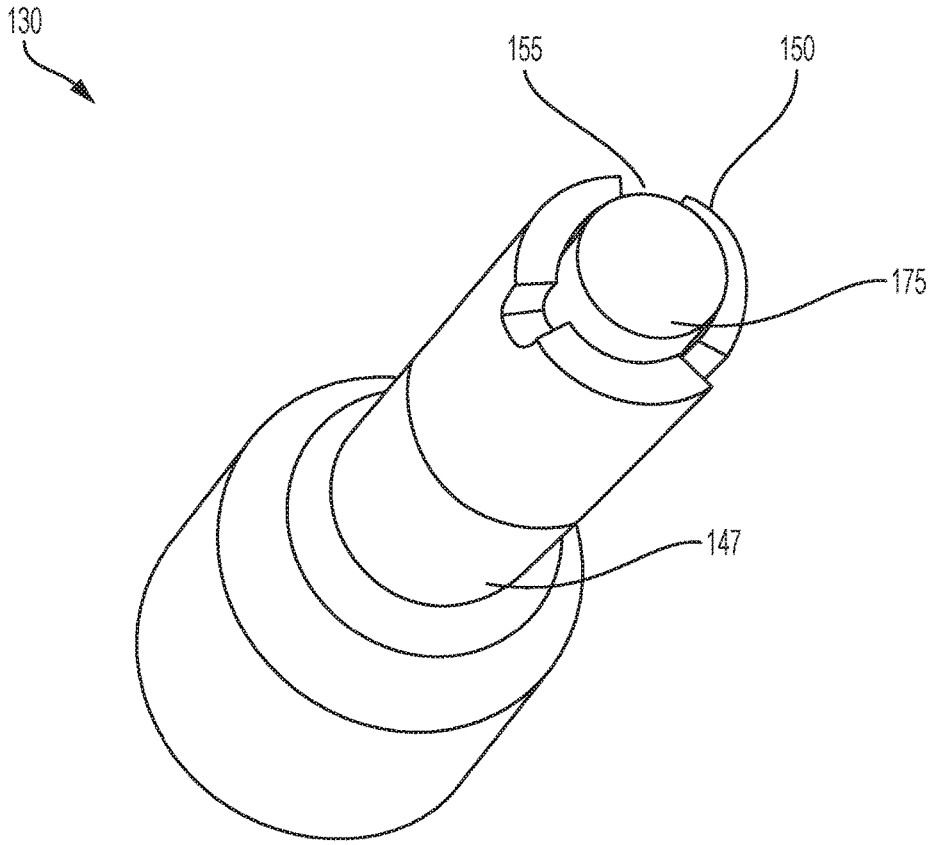
FIG. 3 is a top perspective view of a vaporizer tip according to at least some of the presently disclosed embodiments.
Figure 4:
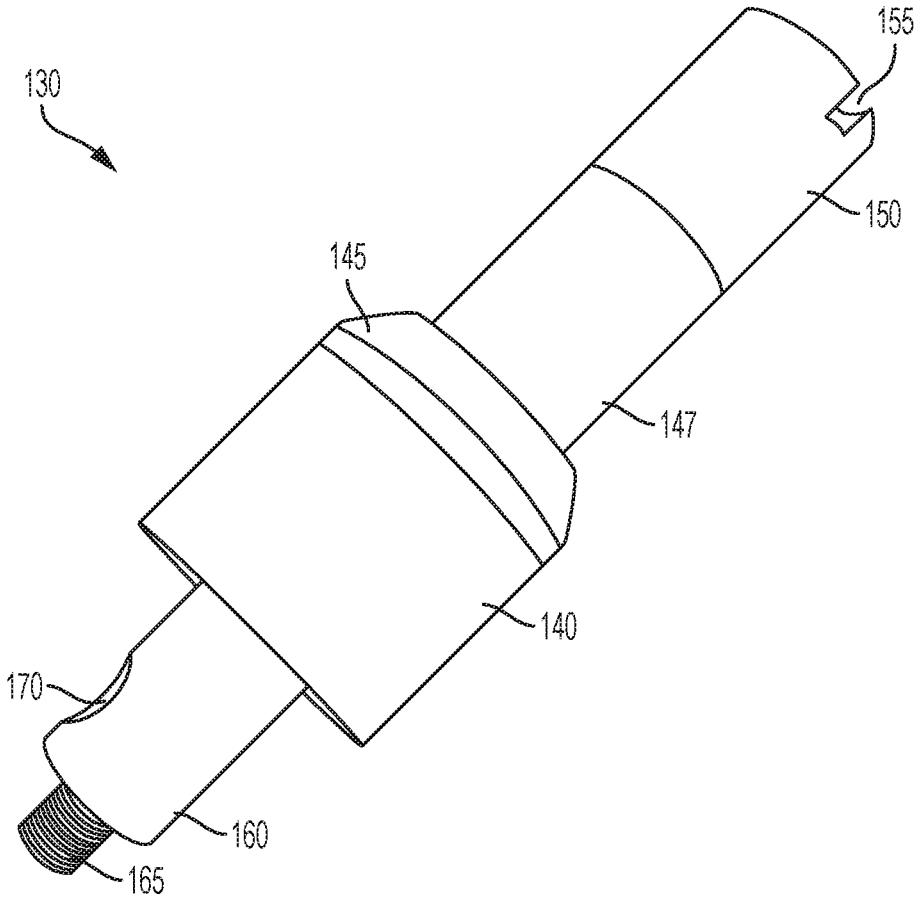
FIG. 4 is a side view of a vaporizer tip according to at least some of the presently disclosed embodiments.
Figure 5:
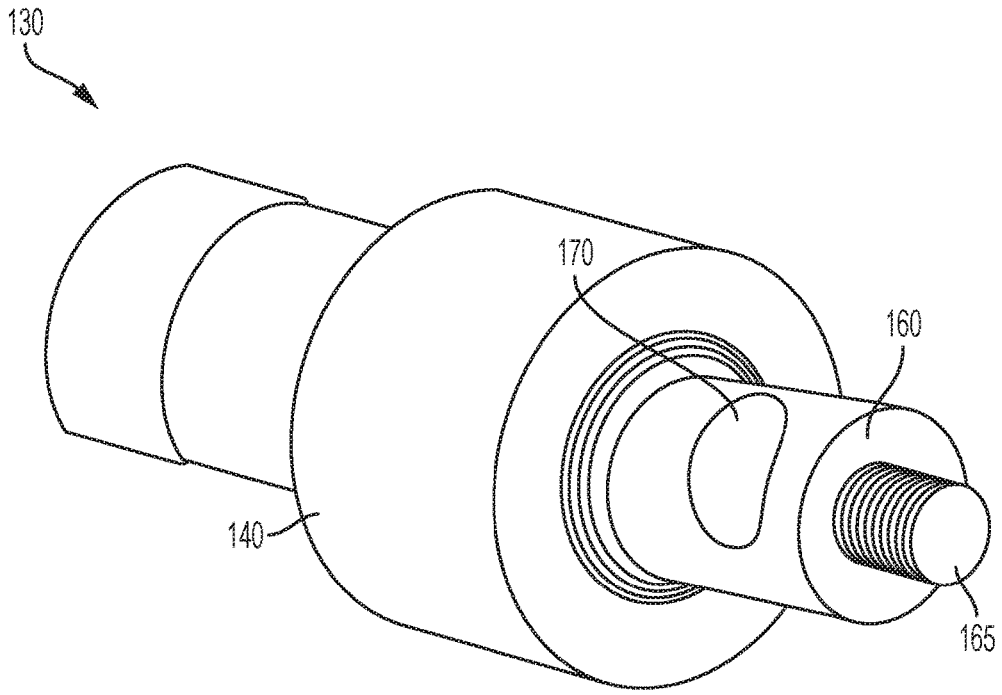
FIG. 5 is a bottom perspective view of a vaporizer tip according to at least some of the presently disclosed embodiments.

A stem 160 can connect the tip 130 to the body 105 of the vaporizer 100. For example, the tip 130 can include tip threads 165 that couple the tip 130 to threads of the body 105, as discussed in U.S. patent application Ser. No. 15/475,455, the contents of which are incorporated by reference herein in their entirety. The tip 130 can also include an opening 160 for allowing air to pass into the tip 130 and through the coils of the tip 130 where product can be heated and combusted. The opening 170 can be located on the side of the stem 160 as shown in FIG. 2 and elsewhere in the drawings, and can provide the necessary ventilation to allow air to better flow through the tip 130 and into the user's mouth.

The coil 175 provides heat to consume the product when the user wishes to heat the product. The user can push the power button 115 on the vaporizer 100 and cause power to flow to the coil 175. The supply of power will heat the coil 175 based on the electrical energy provided to the coil 175 and the magnetic force caused by the coil 175. In so doing, the coil 175 can heat the product and vaporize it, allowing the user to consume the product via the mouthpiece 122.

FIG. 6 is an exploded view of the tip 130 according to at least some of the presently disclosed embodiments. As shown, the tip 130 includes the tip threads 165 connected to the stem 160 having the opening 170. The stem 160 is coupled to the base 140 using known means, and the base 140 is coupled to the taper 145. More specifically, in the exemplary embodiment shown in FIG. 6, the base 140 includes a cap 177 that acts as a foundation for a positive pole 180 and a silica gel part 185 for insulation of electric energy and heat. The cap 177, positive pole 180, and silica gel part 185 are then coupled together by a taper base 190 of the taper 145. As shown, the taper 145 can couple with the base 140 and the taper base 190 can insert into the base 140, and extend to the cap 177, thereby sandwiching the positive pole 180 and silica gel part 185 between the base 140 and taper 145.

As shown, the components of the tip 130 are themselves hollow to facilitate an air flow path through the tip 130 and through a central axis of the coil 175. This air flow path provides improved ventilation and air flow as compared to vaporizers with solid tips or with tips that draw their air from the sides of the vaporizer rather than through a linear path from one end to the other.

A support 190 can include support threads 192 that connect with the remainder of the tip 130, for example, at the taper 145 or elsewhere. In this manner, a user can replace the extension portions 147, 150 easily if these portions 147, 150 are broken or for any other reason. The metallic portion 147 can slide around the support 190 and into an opening in the taper 145, and the ceramic portion 150 can extend from the metallic portion 147 and be coupled to the support 190 via a ring 195. That is, the ring 195 can snap fit, friction fit, or otherwise couple to the support 190, or can otherwise be coupled to any other portion of the tip 130.

As shown, the ceramic portion 150 can include a lower section 197 that fits within the support 190. This lower section 197 can be made of ceramic as well but can be subjected to fewer stresses due to the stability of the support 190 and the metallic portion 147.

As discussed, the metallic portion 147 need not be metallic at all, and is simply so in a preferred embodiment. The metallic portion 147 could be made of any other material that is more ductile than the ceramic portion 150. Further, the ceramic portion 150 need not be ceramic at all, and is only so in a preferred embodiment. The ceramic portion 150 can be any material. In certain embodiments, the two portions 147, 150 can be referred to as a first portion 147 and a second portion 150, where the first portion is made of a material more ductile than the second portion 150. In still other embodiments, the first portion 147 is more resistant to failure in general as compared to the second portion 150.

As discussed herein, the presently disclosed embodiments can be used with a quartz crystal atomizer to combust the product being consumed. However, any type of tip can be implemented without departing from the spirit and scope of the present invention. For example, a ceramic atomizer or standard vaporizer tip could be implemented with the inventive concepts discussed throughout this specification.

The presently disclosed embodiments have also been described with reference to a coil as the heating element. However, any heating element can be implemented without departing from the spirit and scope of the present invention. For example, and without limitation, the heating element can be a coil, flame, energized surface, or any other structure that is capable of heating the product.

As used herein, the term "coupled" and its functional equivalents are not intended to necessarily be limited to direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of the inventors' contribution. The actual scope of the protection sought is intended to be defined in the following claims when viewed in their proper perspective based on the prior art.

What is claimed is:

1. A vaporizer tip comprising:

a base;

a stem electrically connected to a power source;

a heating element capable of being activated by the power source upon selective activation by a user, the power being transferred from the power source through the stem and to the heating element;

a first portion surrounding the heating element and composed of a first material, the first portion including at least one gap at an end thereof allowing air to flow to the heating element; and a second portion extending from the first portion and composed of a second material more ductile than the first material.

2. The vaporizer tip of claim 1, wherein the first portion is ceramic and the second portion is metallic.

3. The vaporizer tip of claim 1, further comprising a support and wherein the first portion includes a lower portion with a diameter less than a diameter of a remainder of the first portion, the lower portion and the second portion both being coupled to the support.

4. The vaporizer tip of claim 1, wherein the base, stem, first portion, and second portion are each hollow to allow air to flow through an axial center of the heating element.

5. The vaporizer tip of claim 1, wherein the heating element is a coil.

* * * * *